US007874552B2

(12) United States Patent
Iizuka

(10) Patent No.: US 7,874,552 B2
(45) Date of Patent: Jan. 25, 2011

(54) SHEET POST-PROCESS APPARATUS INCLUDING MOVABLE STACK TRAY, AND SHEET POST-PROCESS METHOD

(75) Inventor: Chiaki Iizuka, Shizuoka-ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/062,429

(22) Filed: Apr. 3, 2008

(65) Prior Publication Data

US 2009/0057976 A1 Mar. 5, 2009

Related U.S. Application Data

(60) Provisional application No. 60/968,547, filed on Aug. 28, 2007.

(51) Int. Cl.

| | |
|---|---|
| ***B65H 33/04*** | (2006.01) |
| ***B65H 39/00*** | (2006.01) |
| ***B65H 29/66*** | (2006.01) |
| ***B65H 31/36*** | (2006.01) |
| ***B65H 39/10*** | (2006.01) |

(52) U.S. Cl. ..... 270/58.19; 270/58.08; 270/58.13; 270/58.14; 270/58.15; 270/58.18; 270/58.28; 271/288; 271/221; 271/202

(58) Field of Classification Search ..... 270/58.09, 270/58.13, 58.14, 58.15, 58.18, 58.19, 58.28
See application file for complete search history.

(56) References Cited

U.S. PATENT DOCUMENTS

| | | | | |
|---|---|---|---|---|
| 5,449,157 | A * | 9/1995 | Kawano et al. | 270/58.11 |
| 6,494,453 | B1 * | 12/2002 | Yamada et al. | 271/288 |
| 6,527,269 | B2 * | 3/2003 | Yamada et al. | 271/221 |
| 2008/0224392 | A1 * | 9/2008 | Oshima | 271/265.04 |

FOREIGN PATENT DOCUMENTS

| | | | |
|---|---|---|---|
| JP | PH08-119518 | A | 5/1996 |
| JP | PH11-165937 | | 6/1999 |
| JP | P2003-26366 | A | 1/2003 |
| JP | P-2005-170578 | A | 6/2005 |

* cited by examiner

*Primary Examiner*—Gene Crawford
*Assistant Examiner*—Yolanda Cumbess
(74) *Attorney, Agent, or Firm*—Patterson & Sheridan, LLP

(57) ABSTRACT

A sheet post-process apparatus according to one example of the present invention includes a movable stack tray for stacking a sheet that is elevated in a vertical direction; a movable tray position detection unit that detects a vertical position of the movable stack tray while a request command for post-processing of the sheet is not received; an upper surface sensor that senses either an upper surface of the movable stack tray or an upper surface of the sheet stacked on the movable stack tray when a first position of the movable stack tray detected by the movable tray position detection unit is lower than or equal to a predetermined first height; and a movable tray moving unit that moves the movable stack tray upward when either the upper surface of the movable stack tray or the upper surface of the sheet stacked on the movable stack tray is not sensed by the upper surface sensor.

11 Claims, 5 Drawing Sheets

SHEET POST-PROCESS APPARATUS INCLUDING MOVABLE STACK TRAY, AND SHEET POST-PROCESS METHOD

CROSS-REFERENCE TO RELATED APPLICATION

This application is based upon and claims the benefit of priority from U.S. provisional patent application No. 60/968,547 filed on Aug. 28, 2007. The entirety of the provisional patent application is incorporated herein by reference.

BACKGROUND OF THE INVENTION (1) Field of the Invention

The present invention relates to a sheet post-process apparatus, a movable stack tray of the post-process apparatus, and a sheet post-process method that are used to perform post-processing of a sheet of, for example, paper that is discharged from an image forming apparatus, such as a copier, printer, or a multifunctional peripheral (MFP) as a multifunctional device.

(2) Description of the Related Art

Sheets, such as paper sheets, printed by an MFP or the like are then discharged from an outlet of a post-process apparatus connected to the MFP or the like (finisher), to be stacked on a stack tray. The number of sheets to be printed is arbitrarily specified by an operator via an operation panel of the MFP or a computer. Thus the number of sheets to be stacked on the stack tray may be only one or two in some case and may be substantially large to make loading amount substantially large in another case.

Since the position of an outlet for printed sheets is fixed, the height of an upper surface of the stack tray (stack surface) from the sheet outlet (difference in level) varies depending on the number of the sheets that have been already stacked on the stack tray. When the difference in level is reduced in size, there occurs a risk that the sheets may not be properly stacked. Therefore, a copier that may perform recording on a large number of sheets is generally designed such that a stack tray is movable, and the height of the stack tray is automatically adjusted, so that sheets can be properly stacked at all times.

Accordingly, when printing is performed on a large number of sheets, the stack tray is moved substantially downward in order to maintain the difference in level of the upper surface of the printed sheet relative to the position of the sheet outlet.

Conventionally, in a case such as described above, the stack tray remains unchanged even after a large number of printed sheets have been removed. Then, when printing is newly started, the stack tray moved substantially downward is moved to a predetermined upper position.

In such a case, the stack tray moves to the predetermined upper position after printing started, it takes a time to the extent of having the risk of causing a delay in subsequent printing.

Therefore, as disclosed in, for example, Japanese Unexamined Patent Application Publication No. 2003-26366, there is known a sheet stacking device in which, for example, the time period until a stack tray moves upward to a predetermined upper position is predicted, and sheets are immediately discharged after the time period has elapsed, thereby to improve the work efficiency as much as possible.

However, even with the device as described above, since printing cannot be performed during the time period until the stack tray moves up to the predetermined position after printing has been instructed, the work efficiency cannot be improved so much.

BRIEF SUMMARY OF THE INVENTION

The present invention is to provide a sheet post-process apparatus including a movable stack tray, and a sheet post-process method that is capable of immediately performing subsequent printing even after printing on a large number of sheets, therefore improving the work efficiency.

According to one aspect of the present invention, there is provided a movable stack tray of a sheet post-process apparatus, the stack tray for stacking a sheet that is elevated in a vertical direction, wherein while a request command for post-processing of the sheet is not received, when a first position of the movable stack tray in the vertical direction is lower than or equal to a predetermined first height, either an upper surface of the movable stack tray or an upper surface of the sheet stacked on the movable stack tray is sensed by an upper surface sensor, and wherein, when either the upper surface of the movable stack tray or the upper surface of the sheet stacked on the movable stack tray is not sensed by the upper surface sensor, the movable stack tray is moved upward.

According to another aspect of the present invention, there is provided a sheet post-process apparatus including a movable stack tray for stacking a sheet that is elevated in a vertical direction; a movable tray position detection unit that detects a vertical position of the movable stack tray while a request command for post-processing of the sheet is not received; an upper surface sensor that senses either an upper surface of the movable stack tray or an upper surface of the sheet stacked on the movable stack tray when a first position of the movable stack tray detected by the movable tray position detection unit is lower than or equal to a predetermined first height; and a movable tray moving unit that moves the movable stack tray upward when either the upper surface of the movable stack tray or the upper surface of the sheet stacked on the movable stack tray is not sensed by the upper surface sensor.

DETAILED DESCRIPTION OF THE INVENTION

An embodiment of the present invention employing an MPF (multifunctional peripheral) of the present invention will be described hereinbelow with reference to the drawings.

Figure 1:
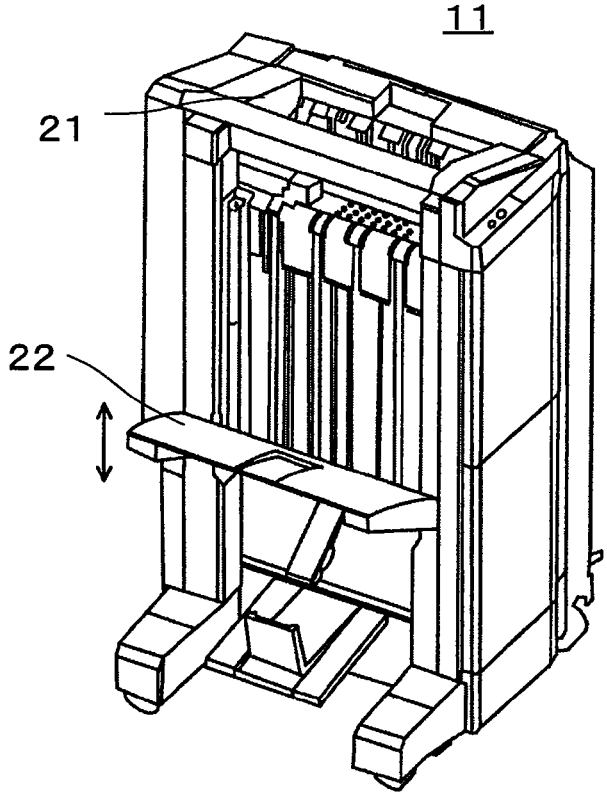
FIG. 1 is a perspective view of a post-process apparatus in accordance with one embodiment of the present invention.
Figure 2:
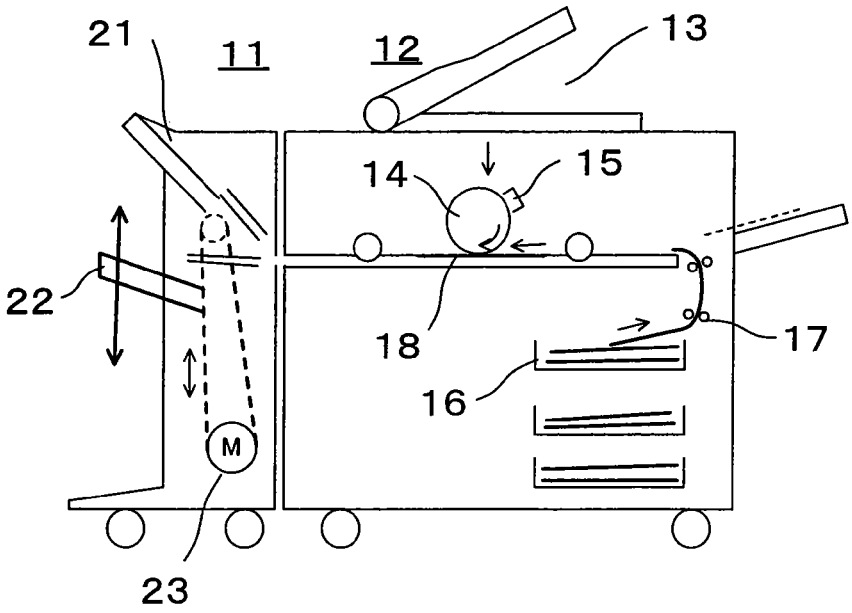
FIG. 2 is a view showing the construction in the state where the post-process apparatus and a multifunctional peripheral (MFP) device are integrally used.

FIG. 1 is a perspective view of a post-process apparatus 11 in accordance with one embodiment of the present invention. FIG. 2 is a view showing the construction in the state where the post-process apparatus 11 and a multifunctional peripheral (MFP) device 12 inclusive of, for example, a copying function is integrally used.

The multifunctional peripheral device 12 herein refers to a device inclusive of a plurality of or multiple functions that, for example, copy an image in hand and that visualize an image signal transmitted across a network. By way of example, a case where a certain original is copied will be described with reference to the multifunctional device 12 shown in FIG. 2.

First, an image on a copying original placed on a copying-original placing unit 13 provided in an upper portion of an apparatus main body 20 of the post-process apparatus 11 is scanned, thereby to form an electrostatic latent image on a photosensitive drum 14. The electrostatic latent image thus formed is then developed in a developing device 15. The image thus developed is stored into, for example, an automatic supply tray 16 and transferred onto and fixed on an unused sheet 18 conveyed via a transport roller 17 and the like. Then, the unused sheet 18 is conveyed to the post-process apparatus 11. The post-process apparatus 11 is independent of the multifunctional device 12. Normally, the post-process apparatus 11 with an input unit being placed in close proximity to a sheet discharge side of the multifunctional device 12.

A post-process apparatus, generally, is an apparatus that ejects sheets printed in a multifunctional peripheral device or the like after performing post-processing, such as stapling processing, of the sheets, and has at least stack trays that are used for stacking of discharged sheets. Generally, stack trays include a top stack tray and a movable stack tray. Normally, the top stack tray stacks a small number of sheets and hence is provided in a unit permitting sheets to easily be picked up, and the movable stack tray is used for stacking a relatively large number of sheets.

Similarly, the post-process apparatus 11 in accordance with one embodiment of the present invention includes a top stack tray 21 and a movable stack tray 22. The top stack tray 21 is provided in an upper portion of the apparatus main body 20. The movable stack tray 22 is provided to a sidewall of the apparatus main body 20, and is movable along a respective upward and download direction ("vertical direction," hereinbelow). The movable stack tray 22 is incorporated in the post-process apparatus 11 and is driven by a movable tray shift motor 23 to move in the vertical direction via a movable belt connected to the movable tray shift motor 23. The movable tray shift motor 23 is a DC motor.

Figure 3:
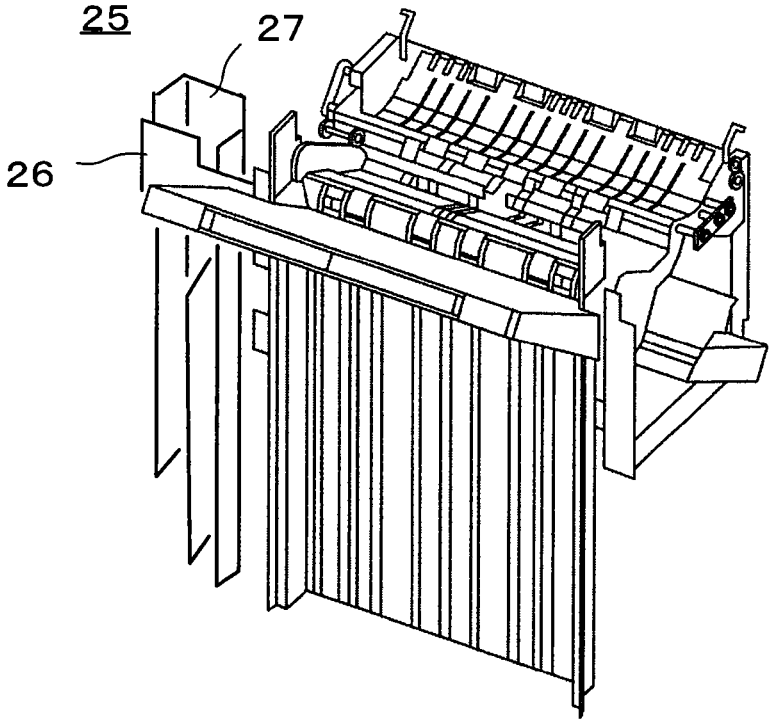
FIG. 3 is a view showing the relationship between a movable stack tray, a movable plate, and a tray position detection mechanism in the post-process apparatus in accordance with one embodiment of the present invention.
Figure 4:
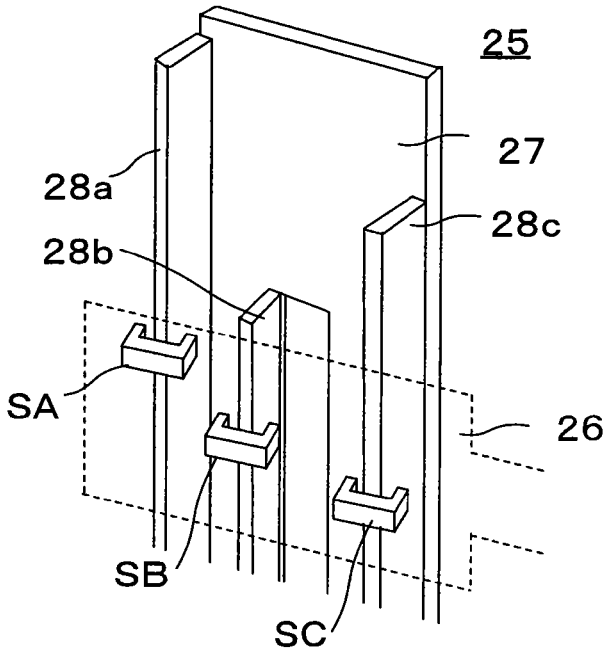
FIG. 4 is a view showing the relationship between the movable plate and a position detection assembly.
Figure 5:
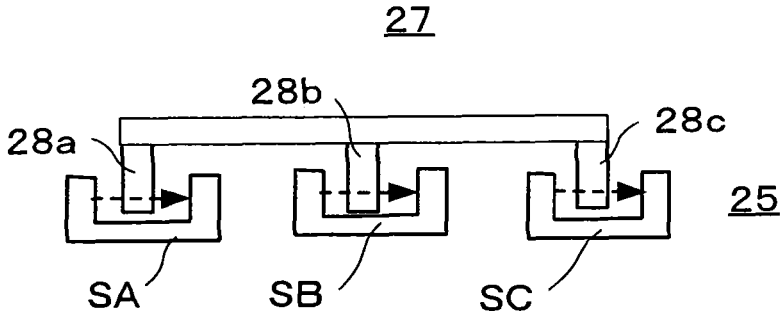
FIG. 5 is a view showing the relationship between respective optical sensors and respective position detection plates.

FIG. 3 shows the relationship between the movable stack tray 22 and a tray position detection mechanism 25 that detects the tray position of the movable stack tray 22. FIG. 4 is a perspective view showing the construction of the tray position detection mechanism 25, and FIG. 5 is a top view of the tray position detection mechanism 25.

The tray position detection mechanism 25 includes a movable plate 26 (surrounded by the broken line in FIG. 4) and a position detection assembly 27 provided in correspondence to the movable plate 26. The movable plate 26 extends along the horizontal direction of the movable stack tray 22, and is movable along the vertical direction together with the movable stack tray 22.

As shown in FIG. 4, a position-A detection optical sensor SA, a position-B detection optical sensor SB, and a position-C detection optical sensor SC (or, "optical sensors SA, SB, and SC," hereinbelow) are provided to the movable plate 26. The optical sensors SA, SB, and SC, respectively, are optical sensors (switch) each formed from a light source, such as light an emitting diode, and a light receiver that receives a light beam emitted from the light emitting diode.

As shown FIG. 4, the position-A detection optical sensor SA, the position-B detection optical sensor SB, and the position-C detection optical sensor SC are, respectively, provided in diagonal positions to the movable plate 26.

The position detection assembly 27 has a construction in which three position detection plates 28*a*, 28*b*, and 28*c* that are provided vertically to apart at predetermined distances from one another. The position detection plates 28*a*, 28*b*, and 28*c* are provided perpendicular to the baseboard to cut off the light beams emitted from the respective optical sensors SA, SB, and SC at the respective positions. The position detection plates 28*a* and 28*c* are provided on the baseboard, but the position detection plate 28*c* is provided to extend through a through-hole formed in the baseboard in a punching manner, and portions extended from the baseboard are caulked. The positions of upper and lower ends of the respective position detection plates 28*a*, 28*b*, and 28*c* along the vertical direction are different from one another.

Figure 6:
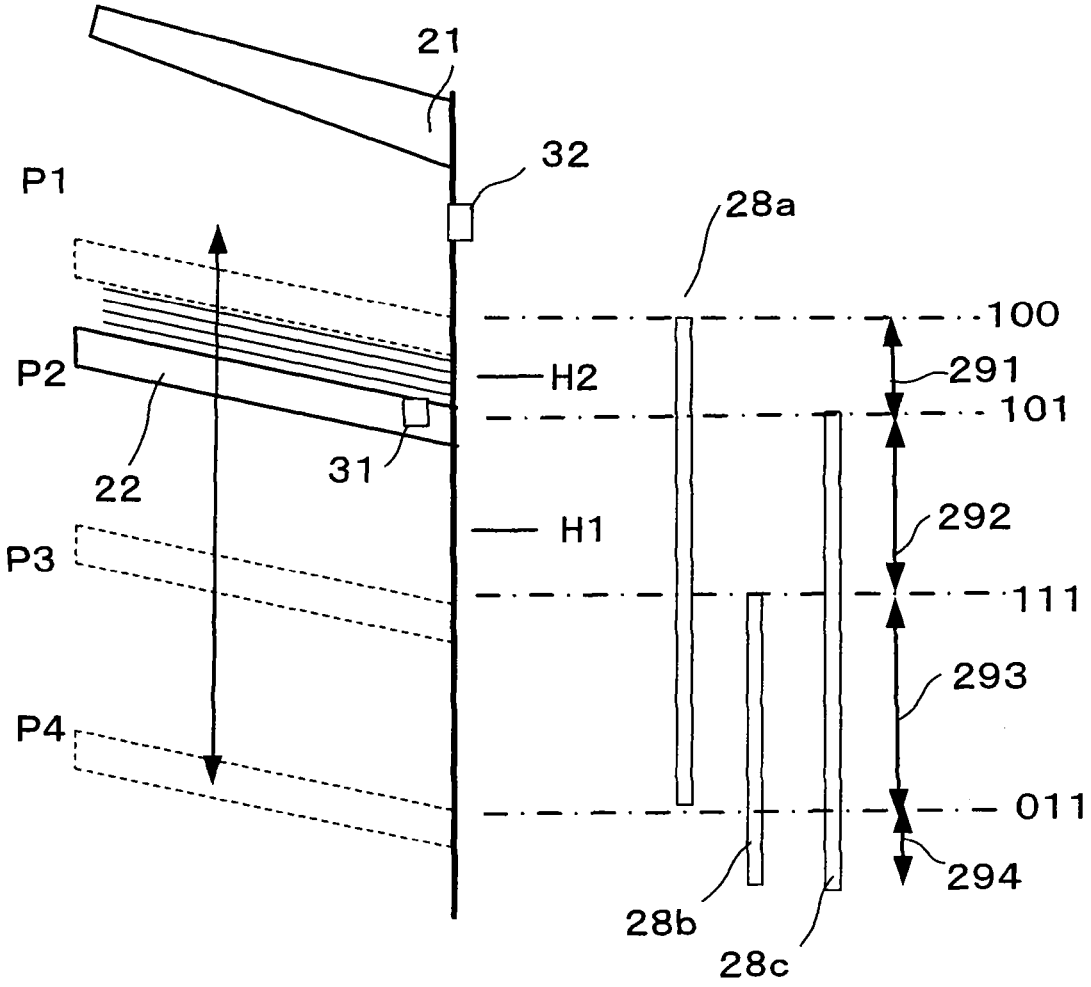
FIG. 6 is an explanatory view showing the relationship in height between the movable stack tray and the position detection plates.

FIG. 6 shows the positional relationship between the vertical positions of the upper surface detection sensor 31 and the respective position detection plates 28*a*, 28*b*, and 28*c*. As shown in FIG. 4, the position in the vertical direction of the movable stack tray 22 is detected depending on whether the light beams emitted from the light emitting diodes of the optical sensors SA, SB, and SC are, respectively, cut off by the position detection plates 28*a*, 28*b*, and 28*c*.

It is now assumed that the switch turns OFF (represented by "0") when the light beam is incident on the light receiver of the light emitting diode of the respective optical sensor SA, SB, SC, and the switch turns ON (represented by "1") when the light beam is cut off by the position detection plate. In the case where the upper and lower ends of the respective position detection plate 28*a*, 28*b*, 28*c* have the vertical positional relationship as are shown in FIG. 5, only the light beam in the position-A detection optical sensor SA is cut off in, for example, a height area 291 where the movable stack tray 22 is positioned highest. As such, it is assumed that the three-digit numeric value (representing a position signal (or, a vertical position signal)) is represented as, for example, "100" for example corresponding to on or off of the respective switch.

In the event that the vertical position signal is "101," it means that the movable stack tray 22 is located in a height area 292. Alternatively, In the event that the vertical position signal is "111," it means that the movable stack tray 22 is located in a height area 293. Still alternatively, in the event that the vertical position signal is "011," it means that the movable stack tray 22 is located in a height area 294.

Thus, in accordance with the respective vertical position signal having the three-digit numeric value, it is detected that the movable stack tray 22 is located in which one of the height areas 291 to 294 in the vertical direction.

As shown in FIG. 6, the movable stack tray 22, which is movable in the vertical direction, includes the upper surface detection sensor 31 that detects whether sheets are stacked on the movable stack tray 22. In addition, the post-process apparatus main body has an upper surface detection sensor 32 that senses either an upper surface of an uppermost sheet stacked on the movable stack tray 22 or an upper surface of the movable stack tray 22.

In the event that a power supply of the post-process apparatus 11 is turned ON, the post-process apparatus 11 is initialized, and the movable stack tray 22 moves upward. After the upper surface of the movable stack tray 22 is sensed by the upper surface detection sensor 32, the movable stack tray 22 is moved downward. In the event that the light beam is cut off by the position detection plate 28*a*, the position-A detection optical sensor SA is set to the ON state. More specifically, in the event that the movable stack tray 22 moves downward, the vertical position signal is set to "100" for the first time. The position in this event is referred to as a position P1 (or, a first position).

The first position P1 of the movable stack tray 22 corresponds to a most basic position ("first home position") at which the sheet is discharged from a buffer tray.

In the event that the movable stack tray 22 further moves downward from the position P1, the light beam is cut off by the position detection plate 28*c*, and the position-C detection optical sensor SC turns ON. More specifically, in the event that the movable stack tray 22 moves downward, the vertical position signal is set to "101" for the first time. The position in this event is referred to as a position P2 (or, a second position). In this case, the position P2 corresponds to a position ("second home position") at which the sheet is discharged from a process tray.

In the event that the movable stack tray 22 further moves downward, the light beam is cut off by the position detection plate 28*b*, and the position-B detection optical sensor SB turns ON for the first time. The position in this event is referred to as a position P3. The position P3 corresponds to a position at which 1,000 to 3,000 sheets are stacked on the movable stack tray 22.

In the event that the movable stack tray 22 is present at the position P3, sheets are stacked. Then, in the event that the uppermost surface of the stacked sheets is detected, the movable stack tray 22 further moves downward.

Then, at the position in the event that the movable stack tray 22 stops, the position detection plate 28*a* cuts off the position detection plate 28*a*, and the position-A detection optical sensor SA turns ON for the first time, the movable stack tray 22 stops. More specifically, the movable stack tray 22 stops at a position P4 in which the vertical position signal is set to "011." The position P4 corresponds to a position of the movable stack tray 22 in which the number of stacked sheets to be stacked exceeds 3,000.

Figure 7:
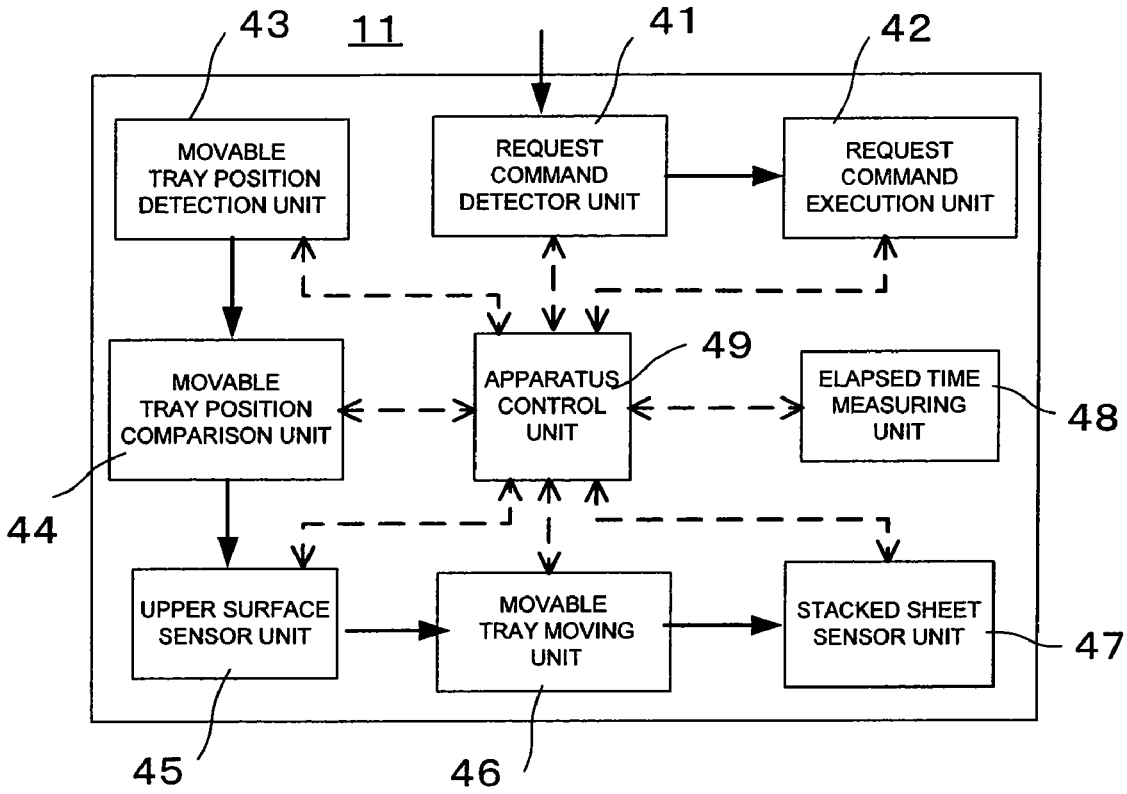
FIG. 7 is a block diagram showing an example of an electrical configuration in accordance with electrical in accordance with one embodiment of the present invention.

FIG. 7 shows an example of the configuration of an electric circuit of the post-process apparatus 11 in accordance with the present embodiment. The post-process apparatus 11 includes a request command detector unit 41, a request command execution unit 42, a movable tray position detection unit 43, a movable tray position comparison unit 44, an upper surface sensor unit 45, a movable tray moving unit 46, a stacked sheet sensor unit 47, an elapsed time measuring unit 48, and an apparatus control unit 49. The request command detector unit 41 detects a request command. Upon receipt of the request command, the movable tray position detection unit 43 executes the command. The movable tray position detection unit 43 detects the position of the movable stack tray 22. The movable tray position comparison unit 44 performs a comparison of the position of the movable stack tray 22 to a predetermined height (a first height H1, a second height H2. The upper surface sensor unit 45 detects the position of either the upper surface of the movable stack tray 22 or the uppermost surface of sheets stacked on the movable stack tray 22. The movable tray moving unit 46 vertically moves the movable stack tray 22 in accordance with the result obtained in the movable tray position comparison unit 44. The stacked sheet sensor unit 47 detects whether a sheet is stacked on the movable stack tray 22. The elapsed time measuring unit 48 detects an elapsed time period from the instance of the detection of the position of the movable stack tray 22. The apparatus control unit 49 controls the respective units described above.

The movable tray position detection unit 43 includes the above-described tray position detection mechanism 25, which includes the optical sensors SA, SB, and SC and the position detection assembly 27. The upper surface sensor unit includes the upper surface detection sensor 32 shown in FIG. 6. The movable tray moving unit 46 includes the movable tray shift motor 23 shown in FIG. 2. The stacked sheet sensor unit 47 includes the upper surface detection sensor 31.

Figure 8:
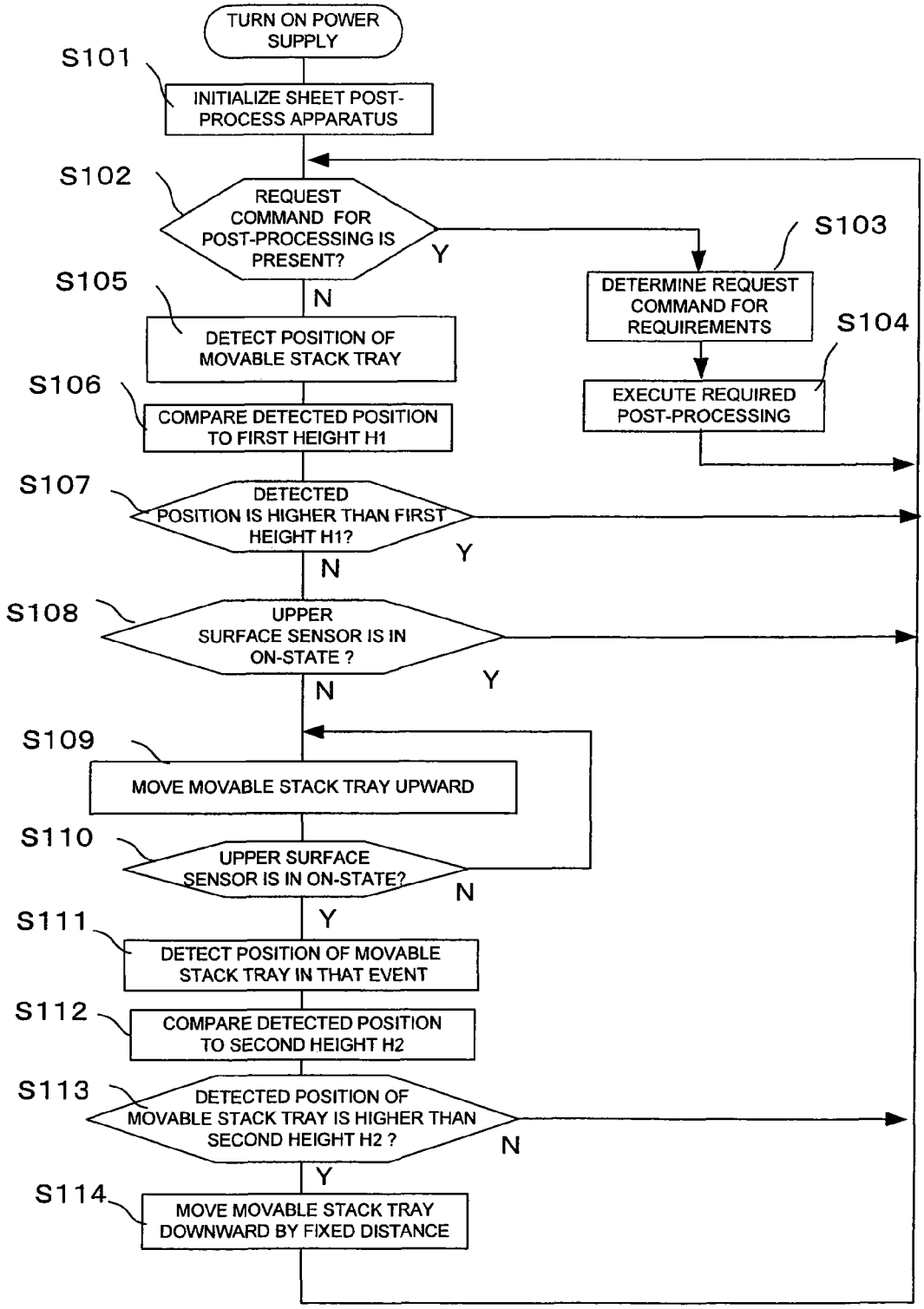
FIG. 8 is an explanatory flow diagram showing operation of the sheet post-process apparatus in accordance with one embodiment of the present invention.

Operation of the post-process apparatus 11 in accordance with the present invention will be described with reference to a flow diagram shown in FIG. 8. In the event that the power supply is turned ON, at step S101 the post-process apparatus 11 is initialized. Then, at step S102, monitoring is performed in the request command detector unit 41 to detect whether a request command for post-processing has been received. If a request command has been received, then the request command is transferred to the request command execution unit 42. In the request command execution unit 42, at step S103 the request command is determined for requirements, and at step S104 required post-processing corresponding to the request command is executed. Subsequently, the operation returns to step S102, and monitoring is performed in the request command detector unit 41 to detect whether a request command for post-processing is present.

If a request command for post-processing has not been received, the operation moves to step S105. At step S105, the current position of the movable stack tray 22 is detected by the movable tray position detection unit 43. Then, at step S106, the detected position of the movable stack tray 22 is compared in the movable tray position comparison unit 44 to the first height H1.

In the event that the detected position of the movable stack tray 22 is higher than the first height H1, the movable stack tray 22 is located at a relatively high position. Hence, the operation simply returns to step S102 without moving up the movable stack tray 22.

As shown in FIG. 6, the first height H1 is set to between the positions P2 and P3, for example. In this case, in the event that the vertical position signal is "100," the movable stack tray 22 is located in the height area 291. Accordingly, in this case, the operation simply returns to step S102.

By way of example, suppose that the position of the movable stack tray 22 detected in the movable tray position comparison unit 44 is lower than the first height H1. For example, in the event that the vertical position signal is "111," the movable stack tray 22 is located in the height area 293. In this event, the movable stack tray 22 is located at a sufficiently low position.

In this case, at step S108, in the upper surface sensor unit 45, it is detected in the upper surface sensor unit 45 whether the upper surface detection sensor 32 is in the ON state. The means that, while the movable stack tray 22 is located at a relatively low position, it is detected whether a large number of sheets are stacked on the movable stack tray 22.

In the event that, at step S108, it has been detected that the upper surface detection sensor 32 is in the ON state, a large number of sheets are stacked on the movable stack tray 22. Consequently, the operation simply returns to step S102.

Otherwise, in the event that, at step S108, it has been detected that the upper surface detection sensor 32 is not in the ON state, that is, the upper surface detection sensor 32 is in the OFF state. In this event, the detection result means that the movable stack tray 22 is located at a sufficiently low position, and the number of sheets stacked on the movable stack tray 22 is small.

In this case, the apparatus control unit 49 operates so that, at step S109, the movable tray shift motor 23 of the movable tray moving unit 46 is driven, thereby moving the movable stack tray 22 along the upward direction.

At subsequent step S110, it is detected whether the upper surface detection sensor 32 turns ON. The movable stack tray 22 is kept moving upward until the upper surface detection sensor 32 turns ON. In the event that the upper surface detection sensor 32 has turned ON, at step S111 the movable tray position detection unit 43 again detects the position of the movable stack tray 22.

Subsequently, at step S112, the movable tray position comparison unit 44 performs a comparison of the position of the movable stack tray 22 detected by the movable tray position detection unit 43 to the second height H2. As shown in FIG. 6, the second height H2 is set to the height area 291, for example.

Subsequently, at step S113, it is detected whether the position of the movable stack tray 22 is higher than the second height H2. In the event that the position of the movable stack tray 22 is not higher than the second height H2, the event means that the space between the movable stack tray 22 and the top stack tray 21 is relatively large (refer to FIG. 6). As such, the operation simply returns to step S102 without moving the movable stack tray 22, and monitors whether a request command for post-processing is present.

Otherwise, in the event that the position of the movable stack tray 22 higher than the second height H2, at step S114 the apparatus control unit 49 controls the movable tray moving unit 46 to move down the movable stack tray 22 by a fixed distance. The movable stack tray 22 is thus moved to be apart from the top stack tray 21, thereby causing the sheet to be easily picked up from the movable stack tray 22.

The movable stack tray 22 is thus moved down by the fixed distance in the manner that the movable tray shift motor 23 (DC motor) is operated by a fixed time period after the detection of either the upper surface of either the stacked sheet or the upper surface of the movable stack tray 22.

After above process has been completed, the operation returns to step S102, and monitors whether a request command for post-processing is present.

In the above-described process (at step S114), in the event that the position of the movable stack tray 22 is higher than the second height H2, the movable stack tray 22 may be moved down to a predetermined height instead of the fixed distance.

In the elapsed time measuring unit 48, unless a request command is received from the multifunctional peripheral device 12, the time period is measured after the detection of the position of and the movement of the movable stack tray 22, which have been carried out in the manner described above. Thereafter, when the time period of ten seconds, for example, has elapsed, the operation is resumed from step S105, and detecting step of the position of the movable stack tray 22 and the moving step of the movable stack tray 22 are repeated.

The apparatus control unit 49 controls the request command detector unit 41 and the request command execution unit 42. In addition, the apparatus control unit 49 controls the movable tray position detection unit 43, the movable tray position comparison unit 44, the upper surface sensor unit 45, the movable tray moving unit 46, the stacked sheet sensor unit 47, and the elapsed time measuring unit 48. Thereby, the apparatus control unit 49 executes the detection of the position of and the movement of the movable stack tray 22 in portions of a predetermined time period.

Although not described in the present embodiment, upper- and lower-limit stopper mechanisms are actually provided to prevent the movable stack tray 22 from exceeding an upper limit and a lower limit.

According to the present embodiment, while a request command for post-processing has not been received, the vertical position of the movable stack tray 22 is detected, and then the necessary determinations are performed, whereby the movable stack tray 22 is moved to the predetermined position. Hence, the post-processing can be quickly performed at all times and sheets can be discharged, consequently to enable improving the work efficiency.

Thus, according to the present embodiment described above, the vertical position of the movable stack tray 22 is detected by using the movable plate tray position detection mechanism 25. The tray position detection mechanism 25 includes the movable plate 26, which is fixed to the movable stack tray 22 and which includes three optical sensors SA, SB, and SC, and the position detection assembly 27, which is provided along the vertical direction in face-to-face opposition to and in correspondence to the movable plate 26 and which detects the vertical position of the movable stack tray 22 by cutting off the respective light beams of the optical sensors SA, SB, and SC. However, according to the present invention, the movable tray position can be implemented even in a manner without using a tray position detection mechanism such as described above in the present embodiment.

According to the present embodiment described above, either the upper surface of the sheets stacked on the movable tray 22 or the upper surface of the movable tray 22 is detected by the detection of the ON state of the upper surface detection sensor 31. However, the upper surface can be detected by a detection of the OFF state of the upper surface detection sensor 31.

As above, the present embodiment has been described with reference to the example case in which the first and second heights H1 and H2 are different from one another. However, the first and second heights H1 and H2 can be identical to one another. Thereby, the heights to be compared by the movable tray position comparison unit 44 shown in FIG. 7 are reduced to one height, consequently making it possible to providing an advantage of simplifying the configuration of a comparator circuit of the movable tray position comparison unit 44.

Further, in the embodiment described above, while the post-processing of sheets of paper has been described, objects to be post-processed in accordance with the present invention is not limited to such sheets of paper. According to the present invention, the post-processing objects may be other sheet-shaped recording mediums, such as OHP sheets (each of which is referred to as "sheet").

Further, while the embodiment has been described with reference to the example case in which the present invention is adapted to the MFP (device), the present invention is not limited thereto and can be widely adapted to general post-processing of sheets printed by image forming apparatuses.

While the present invention has been described with reference to one embodiment, the present invention is not limited thereto. Various modifications can be made to respective components and parts of the present invention within the scope of the technical concepts identical or equivalent to those of the invention, and such modifications are incorporated in the invention.

What is claimed is:

1. A sheet post-process apparatus, comprising:

a static stack tray for stacking a first sheet;

a movable stack tray for stacking a second sheet and movable to different vertical positions above, below, and equal to a predetermined first height;

a movable tray position detection unit that detects a first position of the movable stack tray while a request command for post-processing of the sheet is not received;

an upper surface sensor that senses either an upper surface of the movable stack tray or an upper surface of the second sheet stacked on the movable stack tray; and a movable tray moving unit that moves the movable stack tray upward when the first position of the movable stack tray is lower than or equal to the predetermined first height and either the upper surface of the movable stack tray or the upper surface of the second sheet stacked on the movable stack tray is not sensed by the upper surface sensor, and does not move the movable stack tray upward when the first position of the movable stack tray is higher than the predetermined first height.

2. The sheet post-process apparatus including the movable stack tray, according to claim 1, wherein the movable tray position detection unit detects a position of the movable stack tray by using a tray position detection mechanism that includes a movable plate including a plurality of optical sensors each including a light source and a light receiver and a plurality of position detection plates that is provided to extend in vertical direction facing the movable plate and cut off light emitted from the plurality of optical sensors.

3. The sheet post-process apparatus including the movable stack tray, according to claim 1, wherein:

when either the upper surface of the movable stack tray or the upper surface of the second sheet stacked on the movable stack tray is not sensed by the upper surface sensor, the upward movement of the movable stack tray is continued;

when either the upper surface of the movable stack tray or the upper surface of the second sheet stacked on the movable stack tray is sensed by the upper surface sensor, a second position of the movable stack tray is detected by the movable tray position detector; and when the second position is higher than a predetermined second height, which is higher than the predetermined first height, the movable tray moving unit moves the movable stack tray downward.

4. The sheet post-process apparatus including the movable stack tray, according to claim 3, wherein, when the second position is higher than the predetermined second height, the movable tray moving unit moves the movable stack tray downward by a predetermined distance.

5. The sheet post-process apparatus including the movable stack tray according to claim 1, wherein:

the movable stack tray comprises only one movable stack tray provided to a sidewall of the sheet post-process apparatus; and the static stack tray comprises only one static stack tray provided in an upper portion of the sheet post process apparatus.

6. A sheet post-process apparatus, comprising:

an apparatus main body;

a top static stack tray for stacking a first sheet, the top stack tray provided on an upper portion of a sidewall of the apparatus main body;

a movable stack tray for stacking a second sheet, the movable stack tray provided lower than the top static stack tray and movable in a vertical direction to different vertical positions above, below, and equal to a predetermined first height;

a movable tray position detection unit that detects a first position of the movable stack tray while a request command for post-processing of the second sheet is not received;

a movable tray position comparison unit that compares the first position of the movable stack tray detected by the movable tray position detection unit to the predetermined first height;

an upper surface sensor that senses either an upper surface of the movable stack tray or an upper surface of the second sheet stacked on the movable stack tray; and a movable tray moving unit that moves the movable stack tray upward when the first position of the movable stack tray is lower than or equal to the predetermined first height and either the upper surface of the movable stack tray or the upper surface of the sheet stacked on the movable stack tray is not sensed by the upper surface sensor, and does not move the movable stack tray upward when the first position of the movable stack tray is higher than the predetermined first height.

7. The sheet post-process apparatus including the movable stack tray, according to claim 6, the apparatus further comprising an elapsed time measuring unit, wherein, while the request command for post-processing of the second sheet is not received, the movable tray moving unit moves the movable stack tray upward when the first position of the movable stack tray is lower than or equal to the predetermined first height and either the upper surface of the movable stack tray or the upper surface of the second sheet stacked on the movable stack tray is not sensed by the upper surface sensor, and does not move the movable stack tray upward when the first position of the movable stack tray is higher than a predetermined first height, only after a time period measured by the elapsed time measuring unit has elapsed.

8. The sheet post-process apparatus including the movable stack tray according to claim 6, wherein:

the movable stack tray comprises only one movable stack tray provided to a sidewall of the sheet post-process apparatus; and the top static stack tray comprises only one top static stack tray provided in an upper portion of the sheet post-process apparatus.

9. The sheet post-process apparatus including the movable stack tray, according to claim 6, wherein the movable tray moving unit continues the upward movement of the movable stack tray when either the upper surface of the movable stack tray or the upper surface of the sheet stacked on the movable stack tray is not sensed by the upper surface sensor;

the movable tray position detection unit detects a second position of the movable stack tray when either the upper surface of the movable stack tray or the upper surface of the sheet stacked on the movable stack tray is sensed by the upper surface sensor;

the detected second position is compared by the movable tray position comparison unit to a predetermined second height higher than the predetermined first height; and when the second position is higher than the predetermined second height, the movable tray moving unit moves the movable stack tray downward.

10. The sheet post-process apparatus including the movable stack tray, according to claim 9, wherein the movable tray position detection unit detects a position of the movable stack tray by using a tray position detection mechanism that includes a movable plate including a plurality of optical sensors each including a light source and a light receiver and a plurality of position detection plates that is provided to extend in vertical direction facing the movable plate and cut off light emitted from the plurality of optical sensors.

11. The sheet post-process apparatus including the movable stack tray, according to claim 10, wherein, when the second position is higher than the predetermined second height, the movable tray moving unit moves the movable stack tray downward by a predetermined distance.

* * * * *